US006492583B1

(12) United States Patent
Wilkey

(10) Patent No.: US 6,492,583 B1
(45) Date of Patent: Dec. 10, 2002

(54) DRUM HEAD TENSIONING APPARATUS AND METHOD

(76) Inventor: Donnie Wilkey, Rte. 3, Box 343-B, Dresden, TN (US) 38225

( * ) Notice: Subject to any disclaimer, the term of this patent is extended or adjusted under 35 U.S.C. 154(b) by 0 days.

(21) Appl. No.: 09/753,386

(22) Filed: Jan. 3, 2001

(51) Int. Cl.[7] ..... G10D 13/02
(52) U.S. Cl. ..... 84/413; 84/411 R; 84/411 A
(58) Field of Search ..... 84/413, 411 R, 84/411 A, 419, 415

(56) References Cited

U.S. PATENT DOCUMENTS

| | | | | | |
|---|---|---|---|---|---|
| 3,533,324 | A | * | 10/1970 | Price | 84/411 R |
| 4,475,434 | A | * | 10/1984 | Willis | 84/411 R |
| 4,694,726 | A | * | 9/1987 | Silvestri | 84/413 |
| 4,709,613 | A | * | 12/1987 | Powers et al. | 84/413 |
| 4,870,883 | A | * | 10/1989 | Gauger | 84/415 |
| 5,739,448 | A | * | 4/1998 | Toscano | 84/413 |
| 6,043,419 | A | | 3/2000 | Arbiter | 84/411 R |
| 6,093,877 | A | * | 7/2000 | Nickel | 84/415 |

FOREIGN PATENT DOCUMENTS

GB 2075238 * 11/1981

OTHER PUBLICATIONS

Super Gripper; Pearl Drum Professional Drums Catalog; Sep. 1985; 3 pages.

* cited by examiner

*Primary Examiner*—Shih-Yung Hsieh
(74) *Attorney, Agent, or Firm*—Waddey & Patterson, P.C.; David B. Pieper

(57) ABSTRACT

A tension rod positioning assembly and method for installing, replacing, and clamping a drum head between a drum rim and a drum shell using a tensioning rod. The tension rod positioning assembly includes a base plate adapted to be mounted to the drum shell, a slide arm slidably mounted to the base plate and adapted to accept the tensioning rod, and an arm positioning assembly adapted to move the slide arm. The method for removing the drum head from a drum includes providing a drum head mounted between a drum rim and a drum shell on the drum, the drum head tensioned by a drum lug assembly with a drum lug handle connected to a slide arm adapted to slide substantially parallel to the drum shell, the slide arm receiving a tensioning rod with a tensioning rod head, releasing the drum lug handle to move the slide arm towards the drum head to relieve tension on the tensioning rod, moving the drum rim away from the drum shell to allow access to the drum head, and lifting the drum head from the drum shell. The method for installing a drum head on a drum includes providing a drum head and a drum including a drum rim and a drum shell, the drum shell including a drum lug assembly with a drum lug handle connected to a slide arm adapted to slide substantially parallel to the drum shell, and a tensioning rod with a tensioning rod head, placing the drum head on the drum shell, placing the drum rim over the drum head, and tightening the tensioning rod by moving the drum lug handle. A further improvement is found in the drum hoop, which includes a circular drum rim defining a pass-through opening and an elongated slot.

18 Claims, 10 Drawing Sheets

DRUM HEAD TENSIONING APPARATUS AND METHOD

BACKGROUND OF THE INVENTION

The present invention relates generally to drums and the mounting of drum heads. More particularly, this invention pertains to a quick release tensioning apparatus and method for changing drum heads.

FIG. 1 of the drawings shows a side schematic view of a standard prior art fixed drum lug assembly 10 for installing a drum head 14. The drum head 14, including the connected head base 16, is placed over the drum shell 12 and the drum rim 18 is set in place on the head base 16. A tensioning rod 20 is guided through a hole in the drum rim 18 and screwed into the rod connector 22 in the drum lug 24. The drum lug 24 is connected to the drum shell 12 by rim bolts 26. The tensioning rod 20 is then tightened according to the amount of tension desired on the drum head 14. FIG. 2 of the drawings shows a top view of a standard prior art drum rim 18 defining holes 28 for accepting the tensioning rods 20.

Several United States Patents have been directed towards drum head connecting assemblies. These include: U.S. Design Pat. No. D310,538, issued to Yanagisawa on Sep. 11, 1990; U.S. Design Pat. No. D353,612 issued to Yanagisawa, on Dec. 20, 1994; U.S. Pat. No. 4,583,442, issued to Minor on Apr. 22, 1986; and U.S. Pat. No. 4,693,163, issued to Hsieh on Sep. 15, 1987. Each of these patents is briefly outlined in the following discussion and is hereby incorporated by reference.

U.S. Design Pat. No. D310,538 issued to Yanagisawa on Sep. 11, 1990, describes a "Bass Drum Lug Casing." This design patent shows the decorative molding of a bass drum lug casing for accepting a tension rod and mounting to the side of a drum shell.

U.S. Design Pat. No. Des. 353,612 issued to Yanagisawa on Dec. 20, 1994, describes a "Tom Tom and Bass Drum Lug Casing." This patent is also directed toward the decorative design of a stationary casing for accepting a tension rod for holding a drum head.

U.S. Pat. No. 4,583,442 issued to Minor on Apr. 22, 1986, discloses a "Drum Latch Assembly." This application is directed towards an anchor assembly rigidly affixed to the drum shell. A power lock grip is pivotally connected by a lever to allow for clamping paws to be disengaged from a drum rim for quick changing of the drumhead.

U.S. Pat. No. 4,693,163 issued to Hsieh on Sep. 15, 1987, describes a "Drum Head Lug Assembly." This application describes the use of a fastener utilizing a lug and a tension rod with a receiver nut in a kidney shaped pocket slot connected with a dowel. The kidney shaped pivot slot allows for the lug assembly to be engaged and disengaged while requiring less turns of the tension rod in order to remove a drumhead. The reduced number of turns of the tension rod is accomplished by utilizing the kidney shaped slot on the fastener.

These patents fail to maximize the advantage to be obtained from a movable drum lug assembly. What is needed then is an improved drum lug tensioning assembly.

SUMMARY OF THE INVENTION

The present invention is directed towards a tension rod positioning assembly and method for installing, replacing, and clamping a drum head between a drum rim and a drum shell using a tensioning rod.

The tension rod positioning assembly includes a base plate adapted to be mounted to the drum shell, which includes a slide arm slidably mounted to the base plate and adapted to accept the tensioning rod, and an arm positioning assembly adapted to move the slide arm.

A further improvement is found in the drum hoop, which includes a circular drum rim defining a pass-through opening and an elongated slot.

Improved methods are taught for using the tensioning rod positioning assembly including a method for installing a drum head and a method for removing the drum head.

A still further improvement utilizes a tensioning pin to lock the slide arm in position in either a retracted or extended position.

A method for removing the drum head from a drum is taught which includes providing a drum head mounted between a drum rim and a drum shell on the drum, the drum head tensioned by a drum lug assembly with a drum lug handle connected to a slide arm adapted to slide substantially parallel to the drum shell, the slide arm receiving a tensioning rod with a tensioning rod head; releasing the drum lug handle to move the slide arm towards the drum head to relieve tension on the tensioning rod; moving the drum rim away from the drum shell to allow access to the drum head; and lifting the drum head from the drum shell. Also taught is a corresponding method for installing a drum head. Detailed descriptions of these apparatus and methods are further described herein.

DESCRIPTION OF THE PREFERRED EMBODIMENTS

Figure 1:
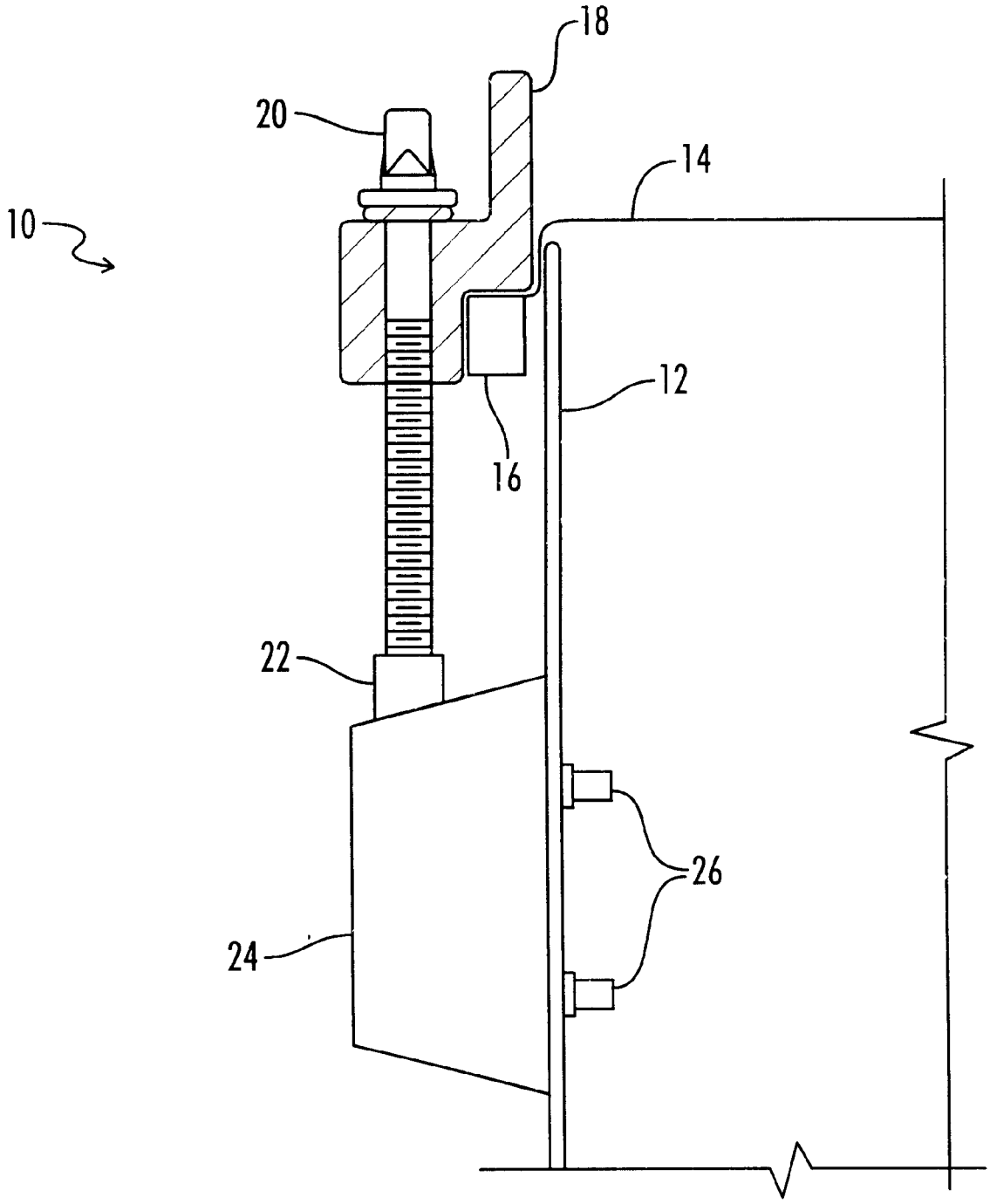
FIG. 1 (PRIOR ART)
FIG. 1 shows a side schematic view of a standard prior art fixed drum lug assembly
Figure 2:
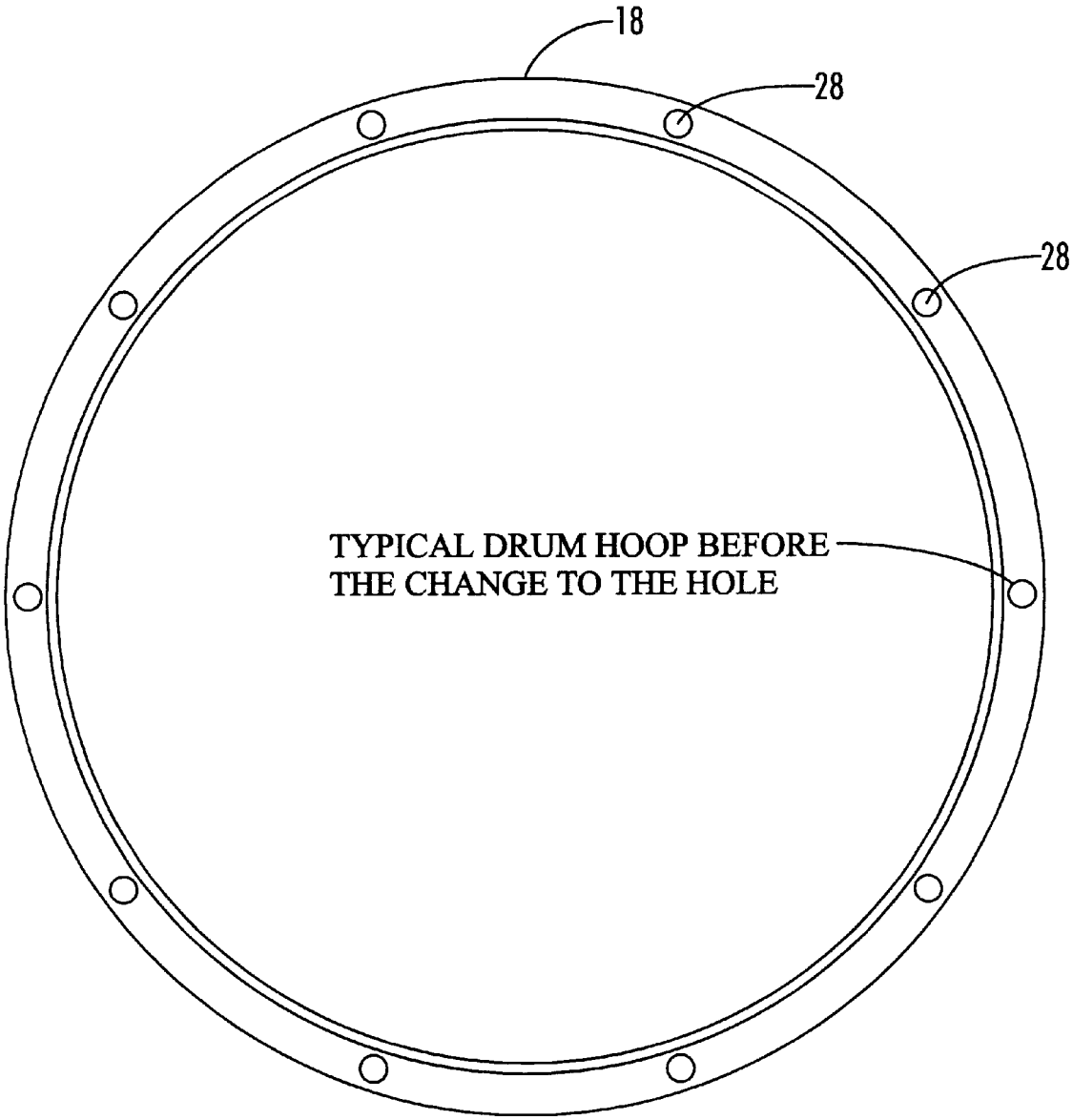
FIG. 2 (PRIOR ART)
FIG. 2 shows a top view of a standard prior art drum rim.
Figure 3:
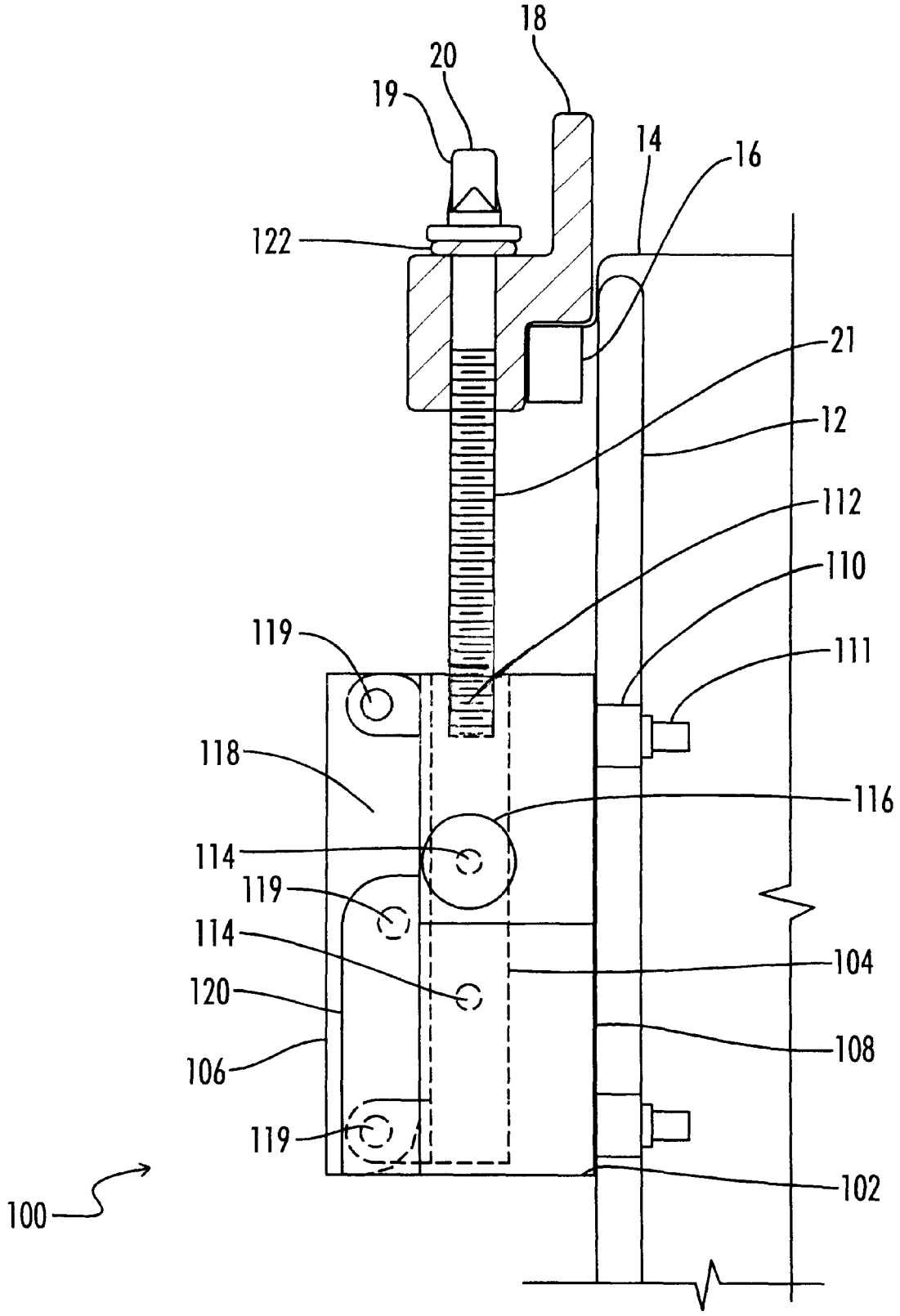
FIG. 3 is a side schematic view of the improved tension rod positioning assembly in a closed position.

As shown in FIG. 3 of the drawings, a tensioning rod position assembling 100 is shown for clamping a drum head 14 between a drum rim 18 and a drum shell 12 using a tensioning rod 20. The tensioning rod positioning assembly 100 includes a base plate 102, which is adapted to be mounted to the drum shell 12. A slide arm 104 is slideably mounted in the base plate 102 and adapted to accept the tensioning rod 20. An arm positioning assembly 106 is also attached to the base plate 102 and the arm positioning assembly 106 is adapted to move the slide arm 104.

The base plate 102 of the tension rod positioning assembly 100 includes an exterior arc wall 108, which is adapted to fit the diameter of the drum shell 12. This allows for the base plate 102 to be mounted to the drum shell without crushing the drum shell 12 or creating a pivot point for the tensioning rod positioning assembly 100 to move on the drum shell 12. The base plate 102 also includes mounting inserts 110, which are attached through the drum shell 12 with mounting bolts 111. These mounting inserts 110 and mounting bolts 111 help to hold the base plate 102 of the tensioning rod positioning assembly 100 to the drum shell 12. These mounting inserts 110 should be of sufficient strength to withstand the tensioning of the drum head 14 by the tensioning rod positioning assembly 100.

The slide arm 104 has an internal thread 112 to accept the external thread 21 on a tensioning rod 20. The slide arm 104 includes a pin-receiving aperture 114 on its exterior for accepting a tensioning pin 116. The tensioning pin 116 is adapted to fit the pin-receiving aperture 114 of the slide arm 104. The tensioning pin 116 is slideably mounted in the base plate 102 and is tensioned by a spring or other device to apply pressure towards the slide arm 104 sufficient to insert the tensioning pin 116 into the pin receiving apperture 114. The tension should be light enough not to prohibit slidable movement of the slide arm 104 within the base plate 102. The slide arm 104 and the tensioning pin 116 are mounted in the base plate 102 such that when a slide arm 104 is either in a retracted or an extended position from the base plate 102 the tensioning pin 116 will extend into a pin receiving apperture 114 to hold the slide arm 104 in the extended position.

Figure 16:
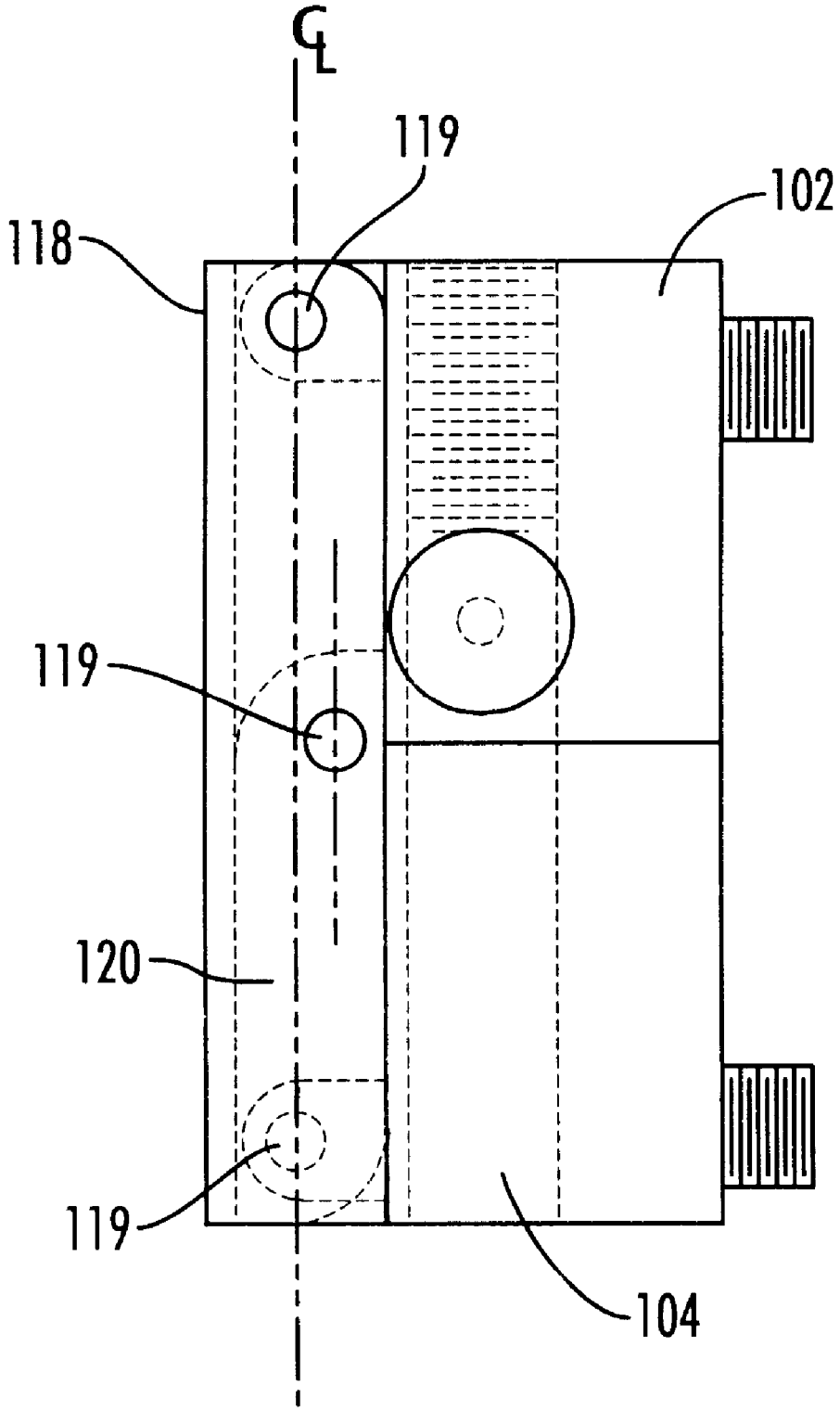
FIG. 16 is a schematic view of the position of the centerline of the hinge pins to hold the base plate, slide arm, and arm positioning assembly in a closed position.

The arm positioning assembly 106 includes a top plate 118, also known as a drum rod handle 118, which is pivotally attached by a hinge pin 119 at its first end to the base 102. The top plate 118 is also pivotally attached by a hinge pin 119 to a pivot arm 120 at a point distal from the first end of the top plate 118. The pivot arm 120 is pivotally attached by a hinge pin 119 at its other end to the slide arm 104, which is slidably attached in the base plate 102. This configuration works such that a slide arm 104 is slidably moved within the base plate 102 when the distal point where the pivot arm 120 is attached to the top plate 118 is moved in relation to the base plate 102. As shown in FIG. 16 of the drawings, the closed position of the hinge pins 119 places the hinge pin 119 for the top plate 118 to pivot arm 120 connection past the centerline of the top and bottom hinge pins 119 so that the unit remains locked in a closed position by the tension from the drum head through the tensioning rod 20 and slide arm 104. Thus, the tensioning pin 116 does not have to be used to hold the slide arm 104 in a retracted position.

The tensioning rod positioning assembly 100 may also include a tensioning rod 20 with an outside diameter for mounting a tensioning rod washer 122. The tensioning rod washer 122 has an inside diameter approximating the outside diameter of the tensioning rod 20 such that the washer 122 is frictionally positioned on the tensioning rod 20. In this manner, the washer 122 will remain in the proper position on the tensioning rod 20 during installation or removal of a drum head 14.

Figure 4:
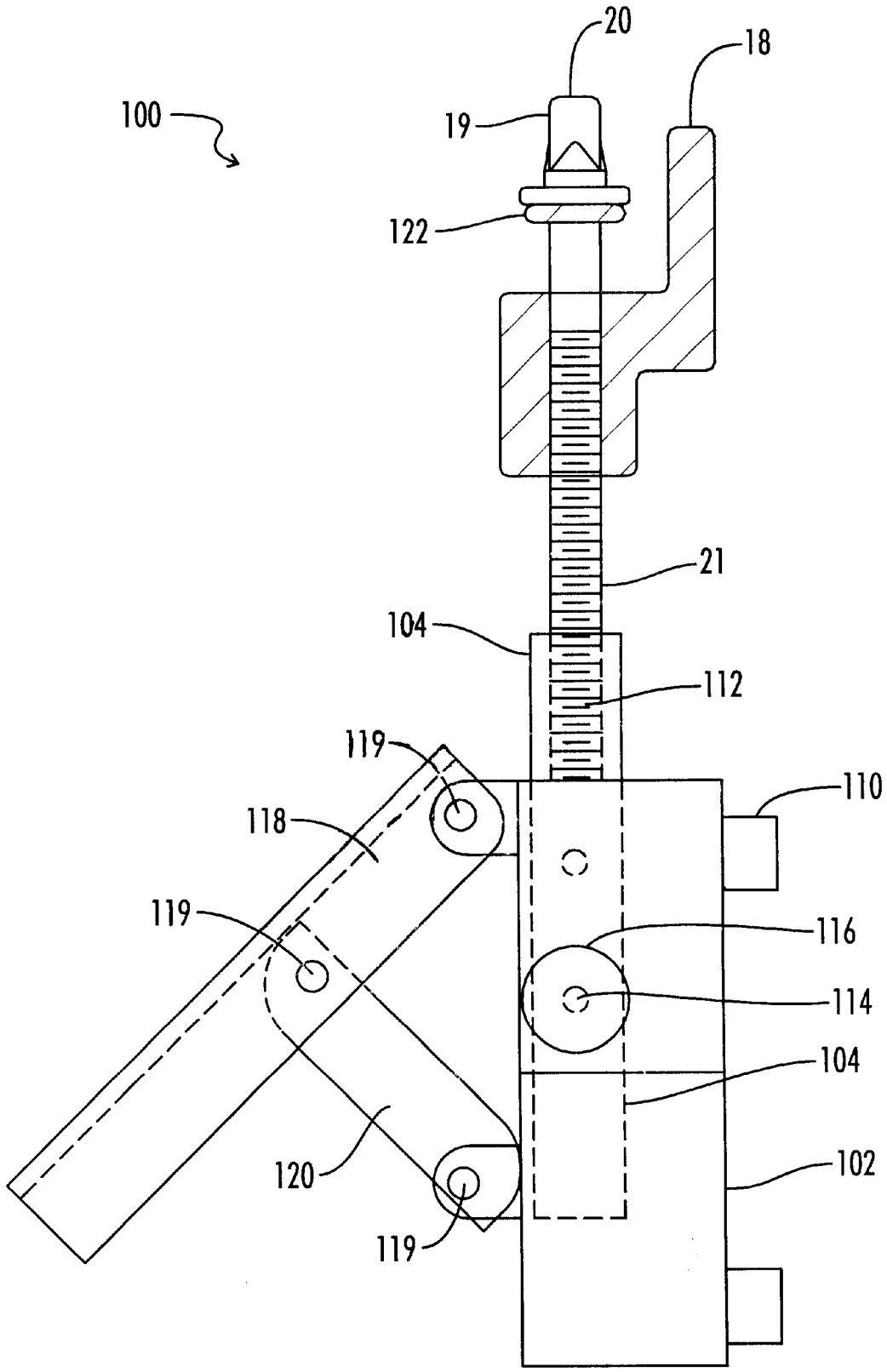
FIG. 4 is a side schematic view of the improved tension rod positioning assembly in an open position.

FIG. 4 of the drawing shows the movement of the top plate 118 and pivot arm 120 in order to extend the slide arm 104 from the base plate 102. Note that the tensioning rod 20 now extends above the drum rim 18 such that the drum rim 18 merely rests upon the drum head 14. It may also be noted in FIG. 4 that the tensioning rod washer 122 has remained in position against the head of the tensioning rod 20 due to the frictional engagement between the tension rod washer 122 and the tension rod 20. Also note in FIG. 4 that the lower pin receiving aperture 114 in the slide arm 104 has now been moved to engage the tensioning pin 116 and hold the slide arm 104 in an extended position from the base plate 102.

Figure 5:
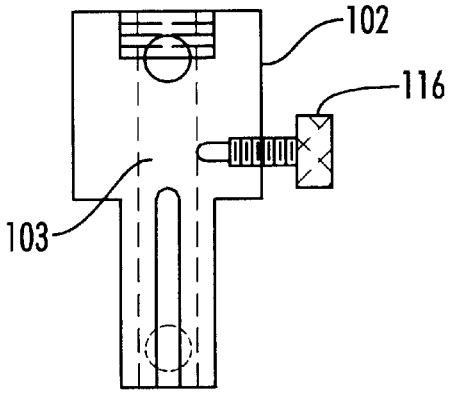
FIG. 5 is a front view of the base plate and tensioning pin for the improved tension rod positioning assembly.
Figure 7:
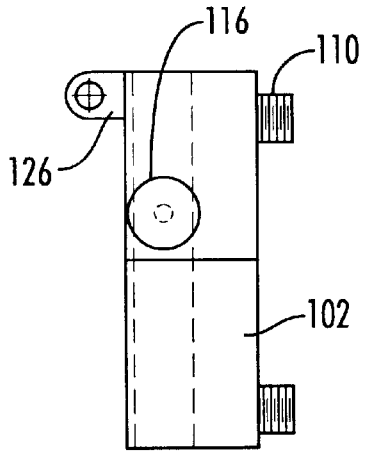
FIG. 7 is a side view of the base plate and tensioning pin for the improved tension rod positioning assembly.
Figure 6:
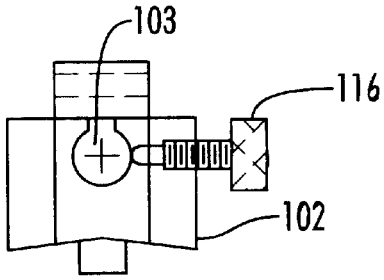
FIG. 6 is a top view of the base plate and tensioning pin for the improved tension rod positioning assembly.

FIGS. 5, 6, and 7 show the base plate 102 with the slide arm 104, the pivot arm 120, and the top plate 118 removed. Thus, it may be seen that there is an aperture 103 for the installation of the slide arm 104 into the base plate 102 such that the tensioning pin 116 will rest against the smooth part of the slide arm 104 and engage the pin receiving aperture 114 when the slide arm 104 is in an extended position from the base plate 102. Detailed in FIG. 6 is the exterior arc 108 of the base plate 102, which is designed to fit the diameter of the drum shell 12.

Figure 8:
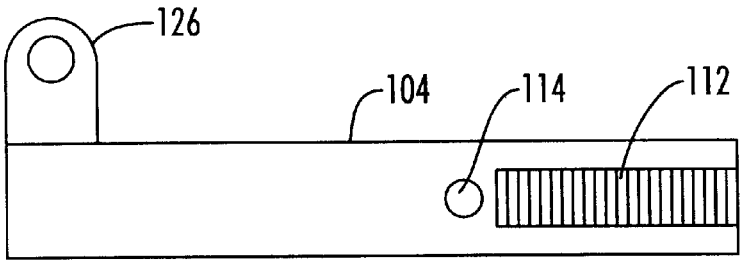
FIG. 8 is a side view of the slide arm with a single pin receiving aperture for the improved tension rod positioning assembly.
Figure 9:
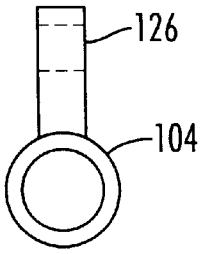
FIG. 9 is a top view of the slide arm for the improved tension rod positioning assembly.

FIGS. 8 and 9 of the drawings detail the shape and configuration of the slide arm 104. The slide arm 104 is designed with an end extension 126 for connection to the pivot arm 120 similar to the end extension 126 on the base plate 102. Also shown in FIG. 8 is the pin receiving aperture 114 for receiving the tensioning pin 116. Note, only one pin receiving aperture 114 is shown on the slide arm 104 in the preferred embodiment because an over-center pivot pin alignment will be used to hold the slide arm 104 in the retracted position. However, two apertures may be utilized for other embodiments. FIG. 8 further details the internal thread 112 of the slide arm 104 for accepting the tensioning rod 20. FIG. 9 shows an end view of the slide arm 104 for installation in the base plate 102.

Figure 10:
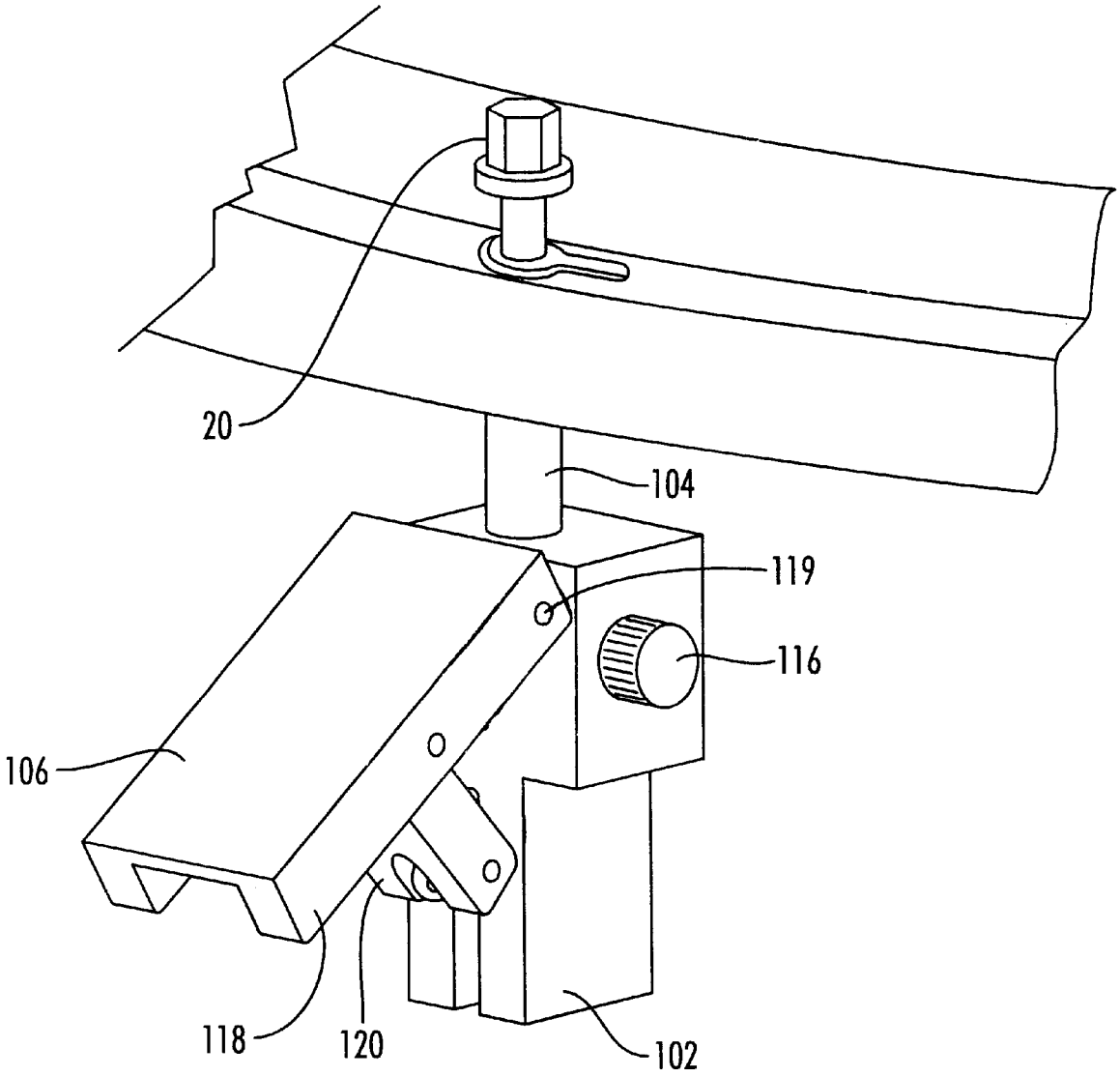
FIG. 10 is an isometric view of the improved tension rod positioning assembly mounted on a drum shell and connected to a drum rim.

FIG. 10 of the drawing shows an isometric view of the tensioning rod position assembly 100 connected to the drum rim 18 and mounted on the drum shell 12. From this angle it may be seen how the top plate 118 connects to the pivot arm 120 for movement of the slide arm 104 within the base plate 102.

Figure 11:
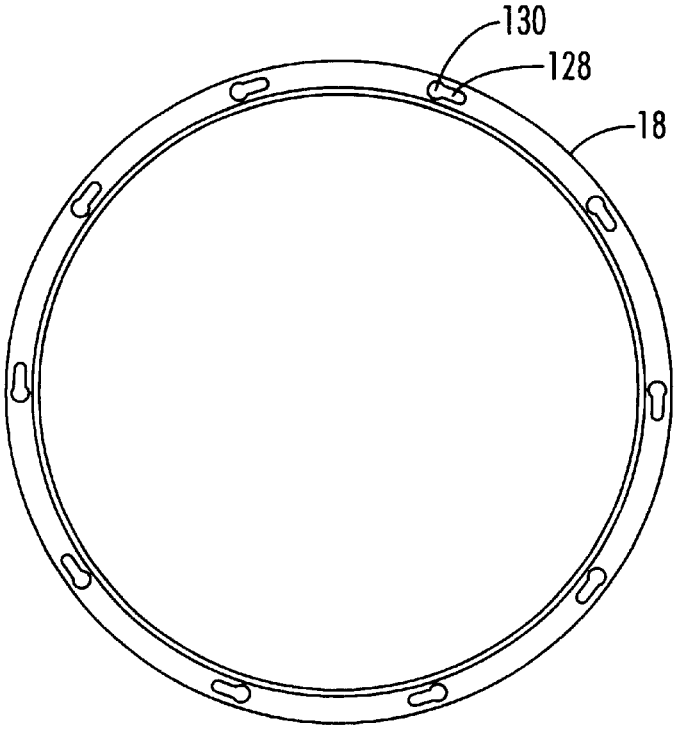
FIG. 11 is a top view of the improved drum rim with elongated openings.
Figure 12:
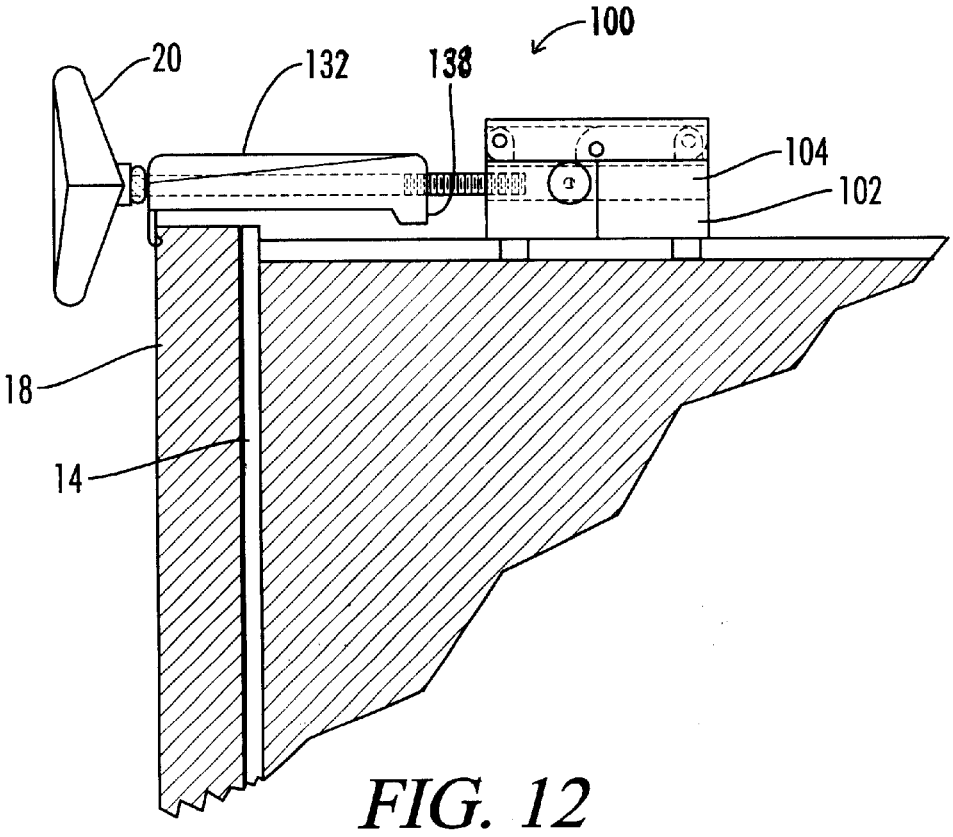
FIG. 12 is a side schematic view of the improved tension rod positioning assembly and releasing bass drum claw assembly in a closed position.
Figure 13:
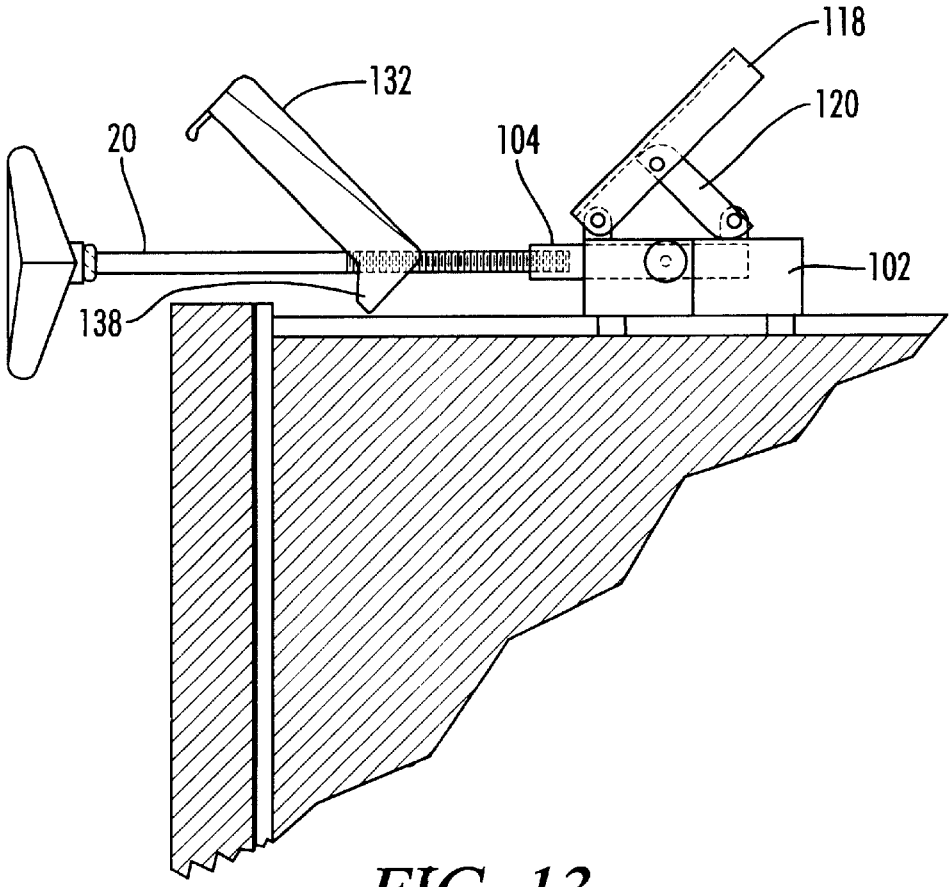
FIG. 13 is a side schematic view of the improved tension rod positioning assembly and releasing bass drum claw assembly in an open position.
Figure 14:
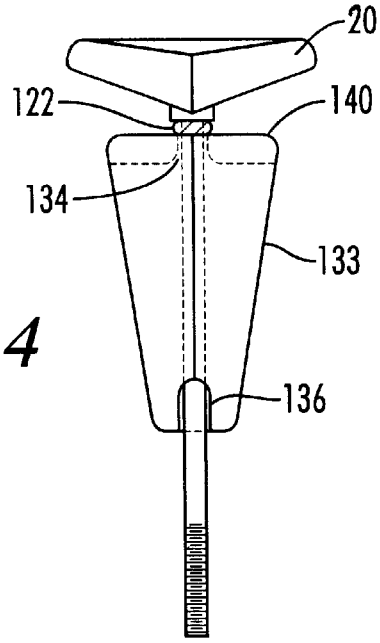
FIG. 14 is a top schematic view of a releasing bass drum claw mounted on a tension rod assembly with a t-style handle.

FIG. 11 of the drawing shows the improved drum rim 18 with the addition of the elongated slots 128 connected to pass through openings 130. The pass through openings 130 are designed to allow the entire tensioning rod head and tension rod washer 122 to pass through the drum rim for easy removal of the drum rim from the drum. The elongated slots 128 are designed to engage the shaft of the tensioning rod 20 and slip underneath the head of the tensioning rod to allow for the tensioning rods to tension the drum head by applying pressure to the drum rim 18. Thus, for installing a drum rim 18 with the elongated slots 128 and pass through openings 130 on a drum, the drum rim 18 would be placed such that the heads of the tensioning rods 20 would pass through the pass through openings 130 and then the drum rim 18 would be rotated at that such the head of the tensioning rods 20 would be oriented over the elongated slots 128 of the drum rim 18.

Figure 15:
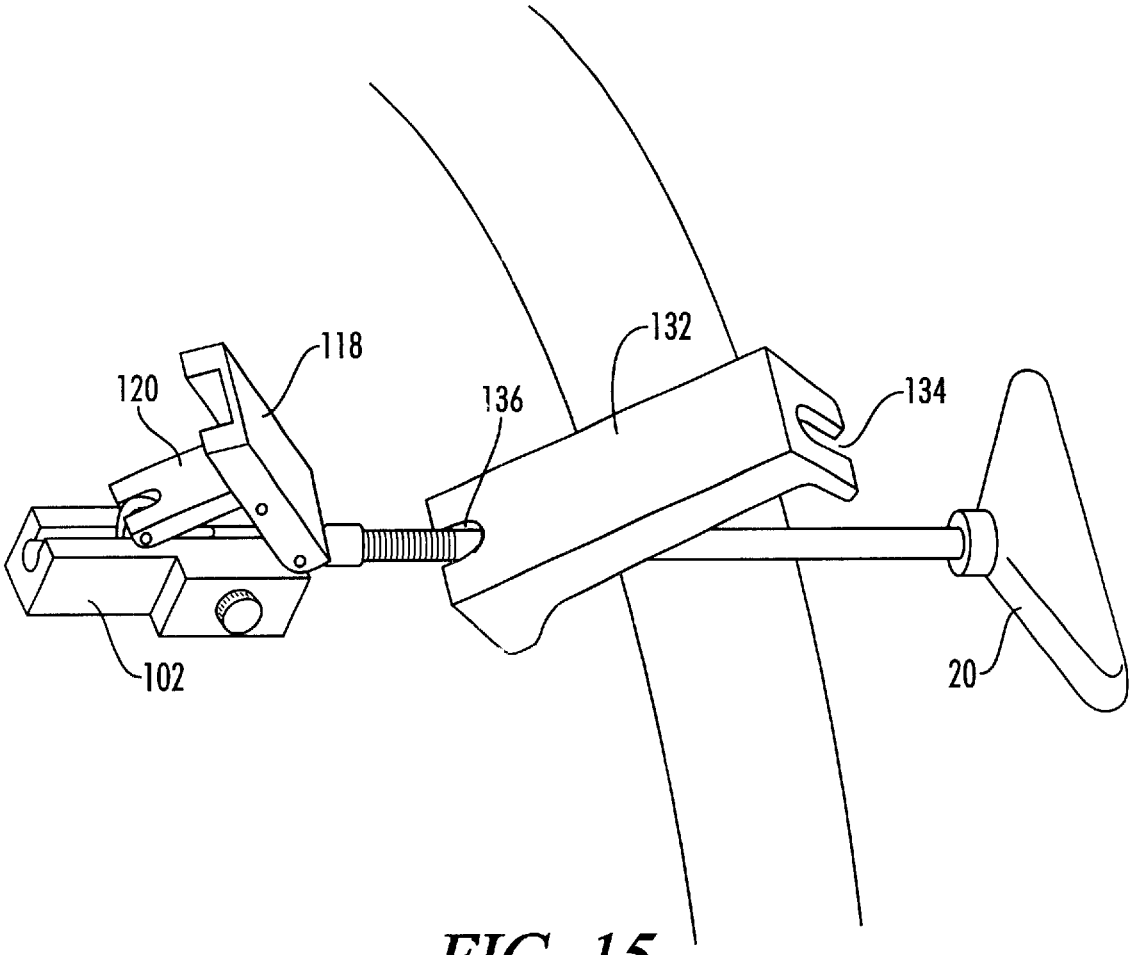
FIG. 15 is an isometric view of the improved tension rod positioning assembly and releasing bass drum claw assembly mounted on a drum shell and positioned for removal of the drum rim.

FIGS. 12 through 15 show a further improvement made to the bass drum claw 132 to allow for removal of a bass drum head 14. The bass drum claw 132 is mounted over the drum rim 18 with a t-style tensioning rod 20, which is connected into the tensioning rod position assembly 100. Once the tensioning rod positioning assembly 100 has been moved to release the tension and extend the slide arm 104 from the base plate 102, the bass drum claw 132 is adapted in the present embodiment to be moved out from the drum rim 18 and rotated up and away from the drum rim 18 to allow for removal of the drum head 14. In order to allow this, the bass drum claw assembly includes a rim slot opening 134 to allow for the claws of the bass drum claw 132 to be placed over the tensioning rod 20 and connect with the drum rim 18. Furthermore, the bass drum claw 132 includes a base slot opening 136, which allows for the bass drum claw 132 to be rotated around the tensioning rod 20 while still being held on the tensioning rod 20. This allows for the bass drum claws 132 to be rotated away from the drum shell 12 without losing the bass drum claws 132 because they are still attached to the tensioning rods 20. In addition, the foot 138 of the base slot opening 136 and the main body 133 control the position of the claw 132 on the tensioning rod 20 and allow for the bass drum claw 132 to apply pressure against the tensioning rod 20 such that the bass drum claw 132 does not slide along the drum shell 12 and scratch the covering of the drum. FIG. 15 of the drawing shows an isometric view of the tensioning rod position assembly 100 installed with a t-style tensioning rod 20 and a bass drum claw 132 with the rim slot opening 134 and bass slot opening 136 including the foot 138.

Thus, it may be seen that a method is shown for removing a drum head 14 from a drum. This method includes providing a drum head 14 mounted between a drum rim 18 and a drum shell 12 on the drum. The drum head 14 is tensioned by a tensioning rod assembly 100, also known as a drum lug assembly 100 with a drum rod handle or drum lug handle 108 connected to a slide arm 104 which is adapted to slide substantially parallel to the drum shell 12. The slide arm 104 is also adapted to receive a tensioning rod 20 with a tensioning rod head 19. The drum lug handle 108 is released to allow for the slide arm 104 to move towards the drum head 14 to relieve tension on the tensioning rod 20. The drum rim 18 may then be moved away from the drum shell 12 to allow access to the drum head 14. The drum head 14 may then be lifted from the drum shell 12. If a standard drum rim 18 is utilized, then the tensioning rods 20 will need to be removed from the slide arm 104. A further improvement would include providing the drum rim 18 with an elongated slot opening 128 connected to a pass-through opening 130 such that the drum rim 18 may be rotated to align the tensioning rod heads 19 with the pass-through openings 130 to allow for removal of the drum rim 18.

This method may also be utilized on a bass drum 138 by providing a bass claw 140, which is adapted to connect to the tensioning rod 20 including a main body 133 defining a rim slot opening 134 and a base slot opening 136. After the tension on the tensioning rod 20 has been removed, the bass drum claw 132 may be removed from the drum rim 18 by unhooking the end of the bass drum claw 132 from the drum rim after releasing the drum lug handle 118 by lifting the rim end of the claw 132 past the tensioning rod 20 through the use of the rim slot opening 134 and pivoting the claw 132 on the tensioning rod through the use of the base slot opening 136.

A further method for installing a drum head 14 on a drum is shown with the present invention which includes providing a drum head 14 and a drum including a drum rim 18 and a drum shell 12. The drum shell 12 includes a drum lug assembly 100 with a drum lug handle 118 connected to a slide arm 104 which is adapted to slide substantially parallel to the drum shell 12. Also provided will be a tensioning rod 20 with a tensioning rod head 19. The method begins by placing the drum head 14 on the drum shell 12 and placing the drum rim 18 over the drum head 14. The tensioning rods 20 are assumed to be installed into the slide arm assemblies. The drum rim 18 may then be tightened by moving the drum log handle 118 towards the base plate to allow for the tensioning rod 20 to be tightened. Further tightening may then be had by turning the tensioning rod 20 in order to utilize the threads in a tensioning rod 20 and the threads in the slide arm 104 to reduce the distance from the tensioning rod head 19 to the base plate 102. A further improvement to this installation may be had by providing a drum rim 18 with an elongated slot opening 128 connected to a pass-through opening 130. This may be done by aligning the tensioning rod head 19 with a pass-through opening 130 on the drum rim 18 and passing the tensioning rod head 19 through the pass-through opening 130. The drum rim 18 may then be rotated to move the tensioning rod head 19 over the elongated slot 128 and away from the pass-through opening 130. This method may be utilized on a bass drum by providing a bass claw 132 with a rim slot opening 134 and a base slot opening 136. The bass claw may be connected to the tensioning rod 20 and may be hooked onto the rim 18 and then tightened by moving the drum lug handle 118 towards the base plate 102 to reduce the distance between the tensioning rod head 19 and the base plate 102. Further tightening may then be had by screwing the tensioning rod into the slide arm 104.

Thus, although there have been described particular embodiments of the present invention of a new and useful Drum head tensioning apparatus and method, it is not intended that such references be construed as limitations upon the scope of this invention except as set forth in the following claims.

What is claimed is:

1. A tension rod positioning assembly for clamping a drum head between a drum rim and a drum shell using a tensioning rod, the tension rod positioning assembly comprising:

a base plate adapted to be mounted to the drum shell;

a slide arm slidably mounted to the base plate and adapted to accept the tensioning rod;

an arm positioning assembly adapted to move the slide arm, the slide arm having an exterior defining a pin receiving aperture; and a pin slidably mounted in the base plate and adapted to fit in the pin-receiving aperture of the slide arm to hold the tensioning rod in a first position.

2. The tension rod positioning assembly of claim 1, the base plate including an exterior arc wall having an arc to fit the diameter of the drum shell.

3. The tension rod positioning assembly of claim 1, the base plate including mounting inserts to attach the base plate to the drum shell.

4. The tension rod positioning assembly of claim 1, the slide arm having an internal thread to accept an external thread on the tension rod.

5. The tension rod positioning assembly of claim 1, further comprising:

a tensioning rod adapted to be vertically positioned in the slide arm, the tensioning rod having a rod shaft with an outside diameter; and a tension rod washer with an inside diameter approximating the outside diameter of the tension rod such that the washer is frictionally positioned on the tensioning rod.

6. The tension rod positioning assembly of claim 1, further comprising:

a bass claw including a rim hook, a back connector, and a shell support, the rim hook defining a rim aperture and the shell support defining a shell aperture, the apertures adapted to allow the bass claw to be moveably positioned for connection to the drum rim for tensioning the drum head and detachment from the drum rim while still attached to tensioning rod to allow for changing of the drum head.

7. A tension rod positioning assembly for clamping a drum head between a drum rim and a drum shell using a tensioning rod, the tension rod positioning assembly comprising:

a base plate adapted to be mounted to the drum shell;

a slide arm slidably mounted to the base plate and adapted to accept the tensioning rod; and an arm positioning assembly adapted to move the slide arm, wherein the slide arm includes a first end, the slide arm and the pin are mounted in the lug bass such that when the slide arm is in an extended position from the lug bass the pin extends past the first end to hold the slide arm in an extended position.

8. The tension rod positioning assembly of claim 7, the base plate including an exterior arc wall having an arc to fit the diameter of the drum shell.

9. The tension rod positioning assembly of claim 7, the base plate including mounting inserts to attach the base plate to the drum shell.

10. The tension rod positioning assembly of claim 7, the slide arm having an internal thread to accept an external thread on the tension rod.

11. The tension rod positioning assembly of claim 7, further comprising:

a tensioning rod adapted to be vertically positioned in the slide arm, the tensioning rod having a rod shaft with an outside diameter; and a tension rod washer with an inside diameter approximating the outside diameter of the tension rod such that the washer is frictionally positioned on the tensioning rod.

12. The tension rod positioning assembly of claim 7, further comprising:

a bass claw including a rim hook, a back connector, and a shell support, the rim hook defining a rim aperture and the shell support defining a shell aperture, the apertures adapted to allow the bass claw to be moveably positioned for connection to the drum rim for tensioning the drum head and detachment from the drum rim while still attached to tensioning rod to allow for changing of the drum head.

13. A tension rod positioning assembly for clamping a drum head between a drum rim and a drum shell using a tensioning rod, the tension rod positioning assembly comprising:

a base plate adapted to be mounted to the drum shell;

a slide arm slidably mounted to the base plate and adapted to accept the tensioning rod; and an arm positioning assembly adapted to move the slide arm, the arm positioning assembly comprising a top plate including a first end pivotally attached to the base plate, and a pivot arm pivotally attached to the top plate at a point distal from the first end of the top plate, and pivotally attached to the slide arm such that the slide arm is slidably moved in the base plate when the distal point of the top plate is pivotally moved in relation to the base plate.

14. The tension rod positioning assembly of claim 13, the base plate including an exterior arc wall having an arc to fit the diameter of the drum shell.

15. The tension rod positioning assembly of claim 13, the base plate including mounting inserts to attach the base plate to the drum shell.

16. The tension rod positioning assembly of claim 13, the slide arm having an internal thread to accept an external thread on the tension rod.

17. The tension rod positioning assembly of claim 13, further comprising:

a tensioning rod adapted to be vertically positioned in the slide arm, the tensioning rod having a rod shaft with an outside diameter; and a tension rod washer with an inside diameter approximating the outside diameter of the tension rod such that the washer is frictionally positioned on the tensioning rod.

18. The tension rod positioning assembly of claim 13, further comprising:

a bass claw including a rim hook, a back connector, and a shell support, the rim hook defining a rim aperture and the shell support defining a shell aperture, the apertures adapted to allow the bass claw to be moveably positioned for connection to the drum rim for tensioning the drum head and detachment from the drum rim while still attached to tensioning rod to allow for changing of the drum head.

* * * * *